US008517504B2

(12) United States Patent
Walker et al.

(10) Patent No.: US 8,517,504 B2
(45) Date of Patent: Aug. 27, 2013

(54) PRINT HEAD HYDRATION SYSTEM

(75) Inventors: Casey Walker, Boulder, CO (US); Carl Bildstein, Lafayette, CO (US); Carlton Begeal, Golden, CO (US); William Hauptman, Boulder, CO (US); Andrew Norte, Westminster, CO (US); John O'Toole, Longmont, CO (US); Michael Miller, Fort Lupton, CO (US)

(73) Assignee: InfoPrint Solutions Company, LLC, Boulder, CO (US)

( * ) Notice: Subject to any disclaimer, the term of this patent is extended or adjusted under 35 U.S.C. 154(b) by 245 days.

(21) Appl. No.: 13/108,333

(22) Filed: May 16, 2011

(65) Prior Publication Data

US 2012/0293573 A1 Nov. 22, 2012

(51) Int. Cl.
*B41J 2/165* (2006.01)

(52) U.S. Cl.
USPC ..... 347/29

(58) Field of Classification Search
USPC ..... 347/29
See application file for complete search history.

(56) References Cited

U.S. PATENT DOCUMENTS

| | | | | |
|---|---|---|---|---|
| 6,299,277 | B1 | 10/2001 | Fujii | |
| 6,899,410 | B2 | 5/2005 | Jeanmaire | |
| 7,255,420 | B2 * | 8/2007 | Usuda | 347/29 |
| 7,344,213 | B2 * | 3/2008 | Iwamoto et al. | 347/6 |
| 2008/0030540 | A1 | 2/2008 | Suzuki | |
| 2008/0180478 | A1 | 7/2008 | Brister et al. | |
| 2009/0109257 | A1 | 4/2009 | Shimazaki | |
| 2010/0045732 | A1 | 2/2010 | Fujimori et al. | |
| 2010/0171789 | A1 * | 7/2010 | Mun et al. | 347/31 |

FOREIGN PATENT DOCUMENTS

JP 2001-138540 * 5/2001

* cited by examiner

*Primary Examiner* — Julian Huffman
(74) *Attorney, Agent, or Firm* — Blakely, Sokoloff, Taylor & Zafman LLP

(57) ABSTRACT

A printer is disclosed. The printer includes an ink jet print head having a plurality of nozzles to mark a printable recording medium with ink and an ink system to provide ink to the nozzles. The ink system includes a print head capping system to cap the nozzles whenever the nozzles are not in use and a hydration system to supply a hydration fluid to the print head capping system to provide moisture to the ink at the nozzles while the nozzles are capped.

15 Claims, 6 Drawing Sheets

PRINT HEAD HYDRATION SYSTEM

FIELD OF THE INVENTION

This invention relates generally to the field of ink jet printing systems. More particularly, the invention relates to maintaining a print engine within an ink jet printing system.

BACKGROUND

An ink jet printer is an example of a printing apparatus that ejects droplets of ink onto a recording medium, such as a sheet of paper, for printing an image on the recording medium. The ink jet printer includes a print engine having one or more ink jet print heads provided with an ink cartridge that accommodates the ink. In operation of the print engine the ink is supplied from the ink cartridge to ejection nozzles of each print head so that a printing operation is performed by ejection of the ink droplets from selected ejection nozzles.

Whenever an ink jet printer remains idle for a duration after printing, print heads may lose water within the ink through the ejection nozzles as the water is absorbed within the capping system, lost to the ambient air, or absorbed within ink that has become less hydrated. As water is lost from the ink, the viscosity may increase, and/or the ink suspension may become unstable, resulting in jetouts. Jetouts typically result in poor image formation quality and require up to several hours of print head maintenance to recover functionality.

In ink jet printers implementing Magnetic Ink Character Recognition (MICR) inks, the MICR particles may settle in, and clog, the print head caps and ambient lines. In either event, service personnel are required to spend additional time manually hydrating the print heads or cleaning jetouts.

Therefore, a print head hydration system is desired.

SUMMARY

In one embodiment, a printer is disclosed. The printer includes an ink jet print head having a plurality of nozzles to mark a printable recording medium with ink and an ink system to provide ink to the nozzles. The ink system includes a print head capping system to cap the nozzles whenever the nozzles are not in use and a hydration system to supply a hydration fluid to the print head capping system to provide moisture to the ink at the nozzles while the nozzles are capped.

In another embodiment, a method is disclosed. The method includes monitoring a fluid detection system within an inkjet printer, determining when hydration fluid may be provided to a print head capping system and supplying a hydration fluid from a hydration system to the capping system to provide moisture to ink at print head nozzles while the nozzles are capped.

BRIEF DESCRIPTION OF THE DRAWINGS

A better understanding of the present invention can be obtained from the following detailed description in conjunction with the following drawings, in which.

DETAILED DESCRIPTION

A print head hydration system is described. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
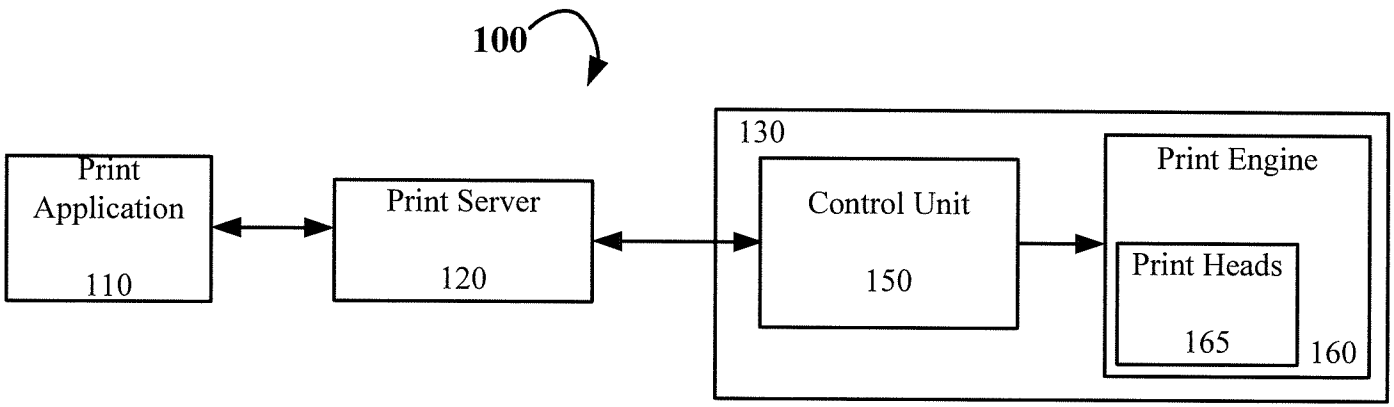
FIG. 1 illustrates one embodiment of a printing system.

FIG. 1 illustrates one embodiment of a printing system 100. Printing system 100 includes a print application 110, a server 120 and a printer 130. Print application 110 makes a request for the printing of a document. Print server 120 processes pages of output that mix all of the elements normally found in presentation documents, e.g., text in typographic fonts, electronic forms, graphics, image, lines, boxes, and bar codes.

Print server 120 subsequently communicates with printer 130. Printer 130 includes a control unit 140 and a print engine 160. Control unit 150 receives print jobs into printer 130. Further, control unit 150 processes and renders objects received from print server 120 and provides sheet maps for printing to print engine 160. Moreover, control unit 150 may include processing logic that may include hardware (e.g., circuitry, dedicated logic, programmable logic, microcode, etc.), software (such as instructions run on a processing device), or a combination thereof.

Print engine 160 includes print heads 165, which provide an imaging process to mark a printable recording medium (e.g., paper). In one embodiment, print heads 165 includes forty print heads, each having fourteen hundred nozzles. However, other embodiments of print engine 160 may be implemented. Further, print engine 160 includes an ink system that provides ink to print heads 165.

Figure 2:
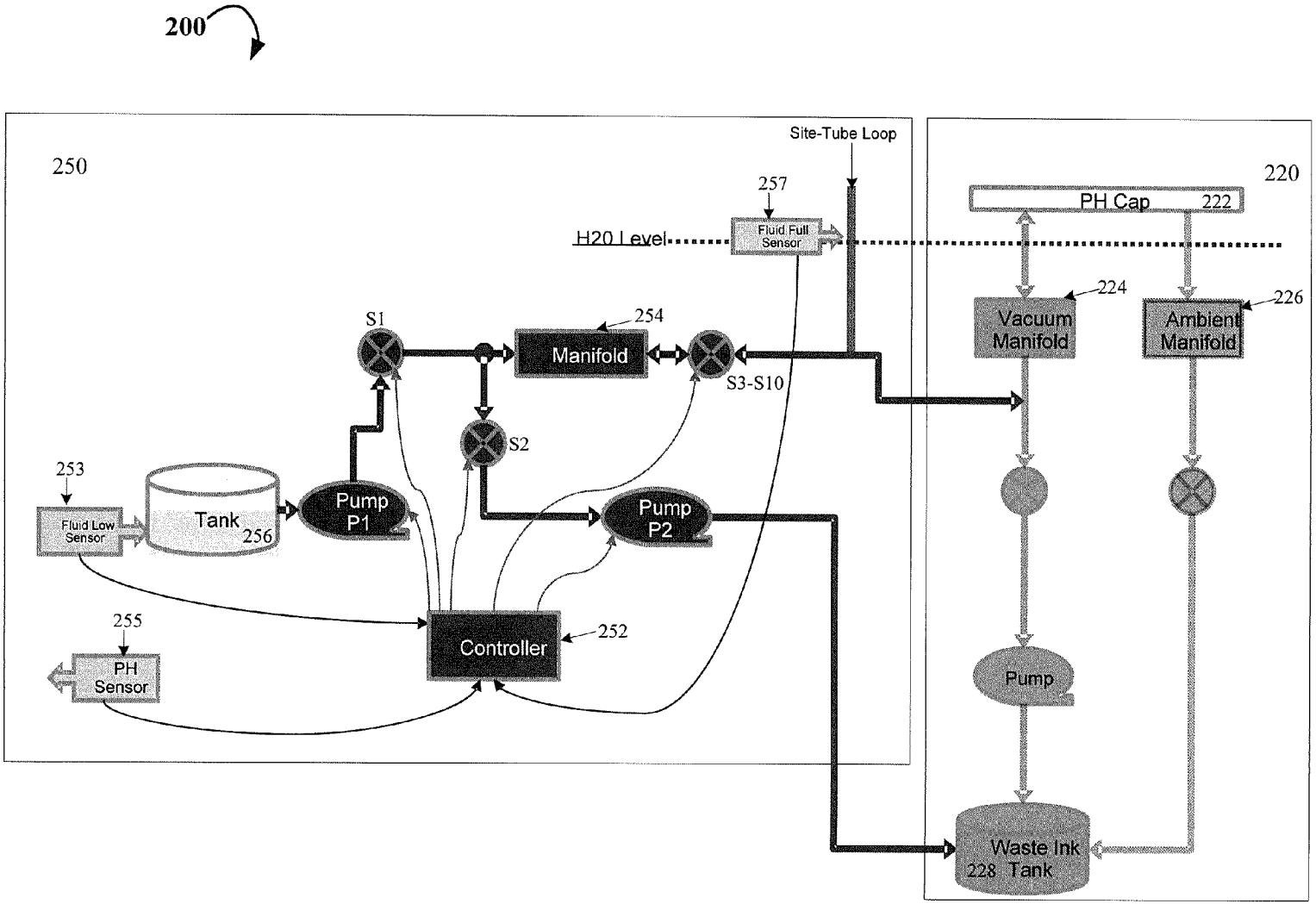
FIG. 2 illustrates one embodiment of a print engine.

FIG. 2 illustrates one embodiment of a print engine ink system 200, which includes a print head capping and maintenance system 220 and a hydration system 250. Print head capping and maintenance system 220 includes a cap 222, vacuum manifold 224 and ambient manifold 226, which operate as a maintenance station for pulling ink through and from a print head during maintenance.

Particularly, cap 222 is used to cover a print head 165 during idle or maintenance to prevent drying, and is uncapped during printing. Vacuum manifold 224 is coupled to a vacuum source via one or more hoses to pull ink from a print head 165. Ambient manifold 226 is coupled to an air source that is used to relieve the vacuum prior to removing cap 222 in order to prevent damage to print heads 165.

Print head capping and maintenance system 220 also includes a pump coupled to vacuum manifold 224 via a solenoid to pump ink into a waste ink tank 228. Waste ink tank 228 is also coupled to ambient manifold 226 via a separate solenoid. As discussed above, print heads 165 or caps 222 may lose water during printing, resulting in conditions that may lead to jetouts.

According to one embodiment, hydration system 250 delivers a hydrating fluid (e.g., water) into print head capping and maintenance system 220 whenever it is determined that hydrating the print heads 165 is required. Hydration system 250 includes a controller 252, a manifold 254 and a water tank 256. Additionally, hydration system 250 includes sensors 251, 253 and 255, pumps P1 and P2, and solenoids S1-S10.

In one embodiment, controller 252 controls the pumping of water from hydration system 250 into print head capping and maintenance system 220. In such an embodiment, controller 252 activates/deactivates one or more solenoids, manifold 254 and pumps in response to input received from one of the sensors. For example, controller 252 activates solenoid S1, manifold 254 solenoids S3-S10 and pump P1 in order to pump water from tank 256 into a line coupled to vacuum manifold 224 upon sensor 257 providing a signal that the print head capping and maintenance system 220 moisture level is too low or a time limit has been reached.

Figure 3:
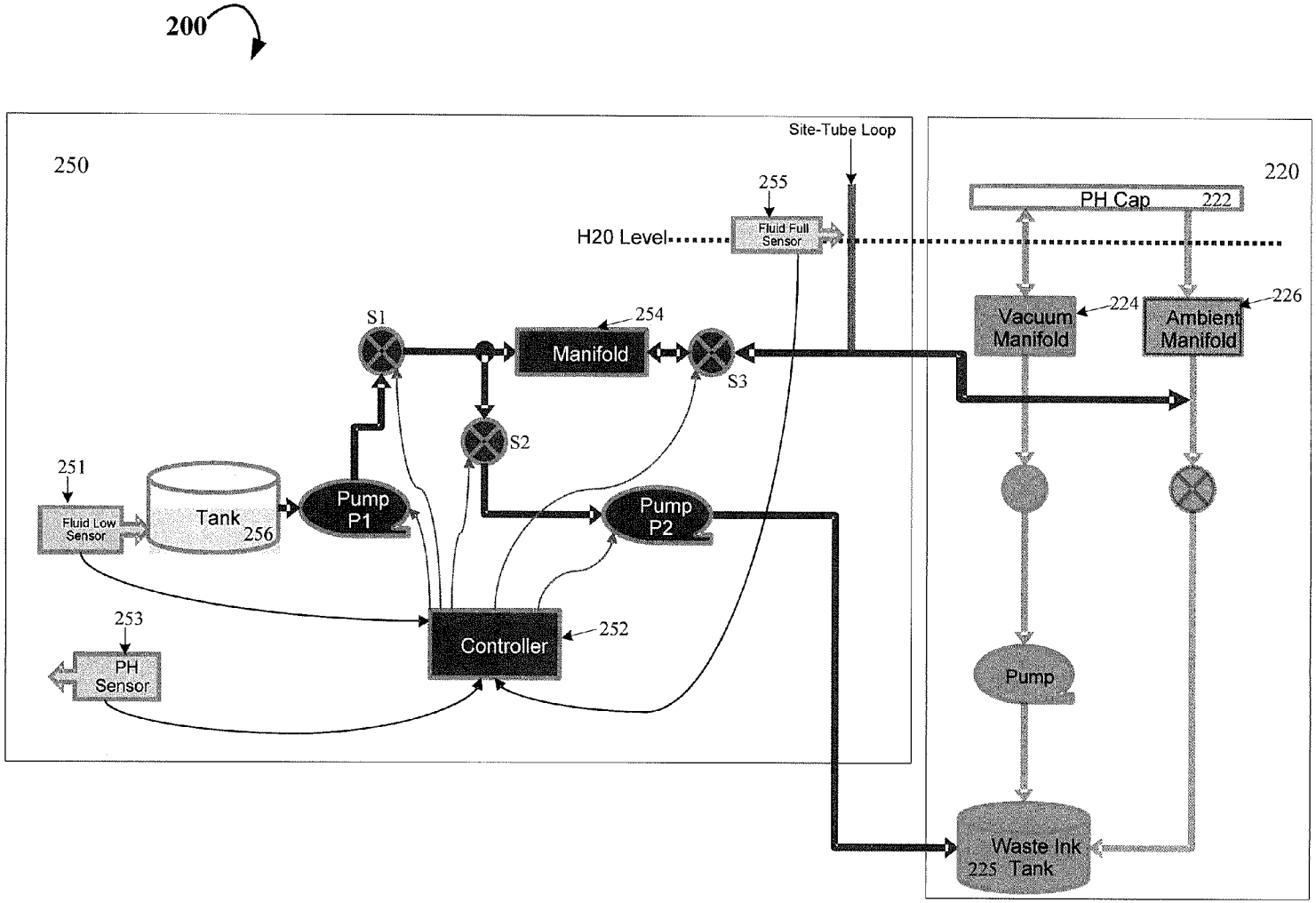
FIG. 3 illustrates another embodiment of a print engine.

The above embodiment is implemented for pigment and dye print head 165 applications. FIG. 3 illustrates another embodiment of print engine 160 in which hydration system 250 pumps water into a line coupled to ambient manifold 226 in order to perform MICR cleaning.

According to one embodiment, hydration system 250 operates in one of three cycles: Start; Fill and Purge. The Start sequence is implemented to initialize hydration system 250 to ensure that conditions are adequate at print head capping and maintenance system 220 for hydration. In one embodiment, hydration may only occur when the printer has been printing for a predetermined length of time (e.g., 10 minutes). In a further embodiment, hydration is restricted to a length of time (e.g., once per twenty-four hour period).

Figure 4A:
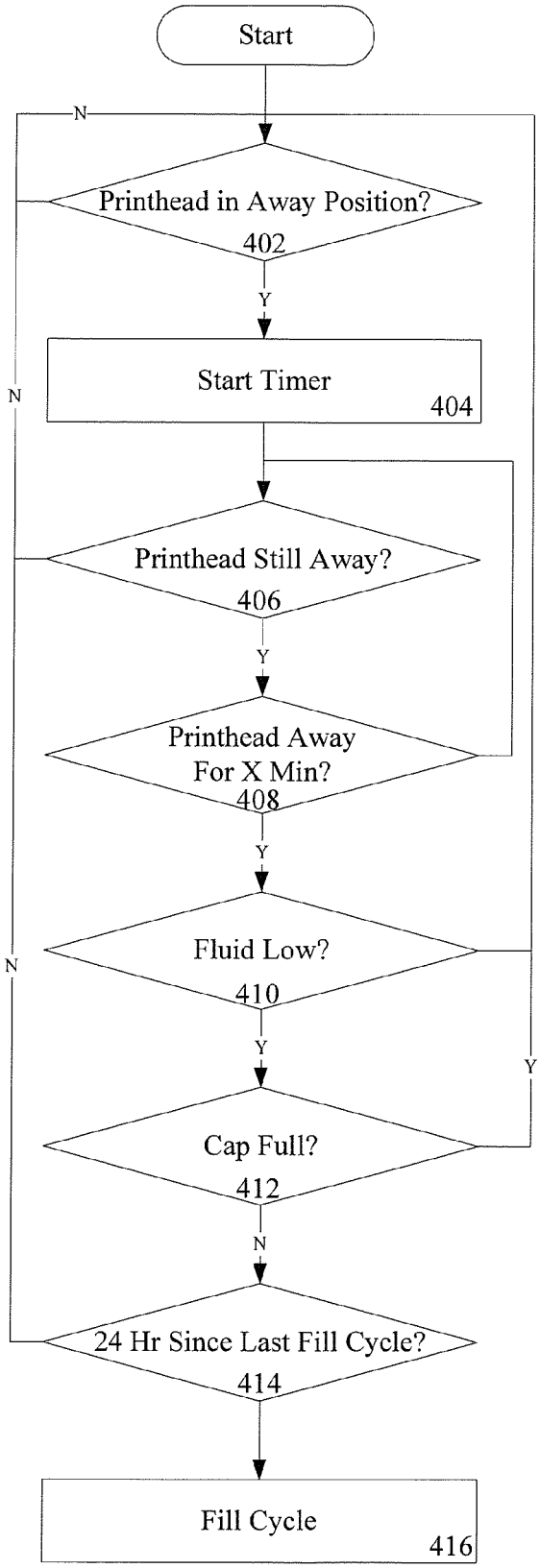
FIGS. 4A-4C are flow diagrams illustrating embodiments of operation for a print head hydration system.

FIG. 4A is a flow diagram illustrating one embodiment of operation for a Start cycle performed at hydration system 250. At decision block 402, it is determined whether the print head 165 is in an away position. If so, a start timer within controller 252 is activated, processing block 404. Otherwise control is returned to decision block 402 where it is again determined whether the print head 165 is in the away position.

At decision block 406, it is determined, by checking the start timer, whether the print head 165 has remained in the away position. If the print head 165 has not remained in the away position, hydration will not start. As a result, control is returned to decision block 402 where it is determined whether print heads 165 are in the away position.

If the print head 165 has remained in the away position, it is determined whether the print head 165 has been in the away position for a predetermined period of time (e.g., ten minutes), decision block 408. If not, control is returned to decision block 408. If the predetermined period has expired since the print head 165 has been in the away position, it is determined whether the fluid level in tank 256 is low (e.g., sensor 253 is on), processing block 410. In one embodiment, a warning message indicating low tank level is generated prior to returning control to decision block 402 upon a determination that the fluid level in tank 256 is low.

Otherwise, it is determined whether the fluid at cap 222 is at a predetermined threshold level (e.g., sensor 257 is on), decision block 412. If the fluid level is detected as being at the predetermined threshold level a warning message providing an indication to check sensor 257 is generated prior to returning control to decision block 402.

If cap 222 is not at the predetermined threshold level, it is determined whether twenty-four hours has elapsed since the previous Fill cycle has been completed, decision block 414. If twenty-four hours has elapsed, the Fill cycle is performed, processing block 416. If not, control is returned to decision block 402.

Figure 4B:
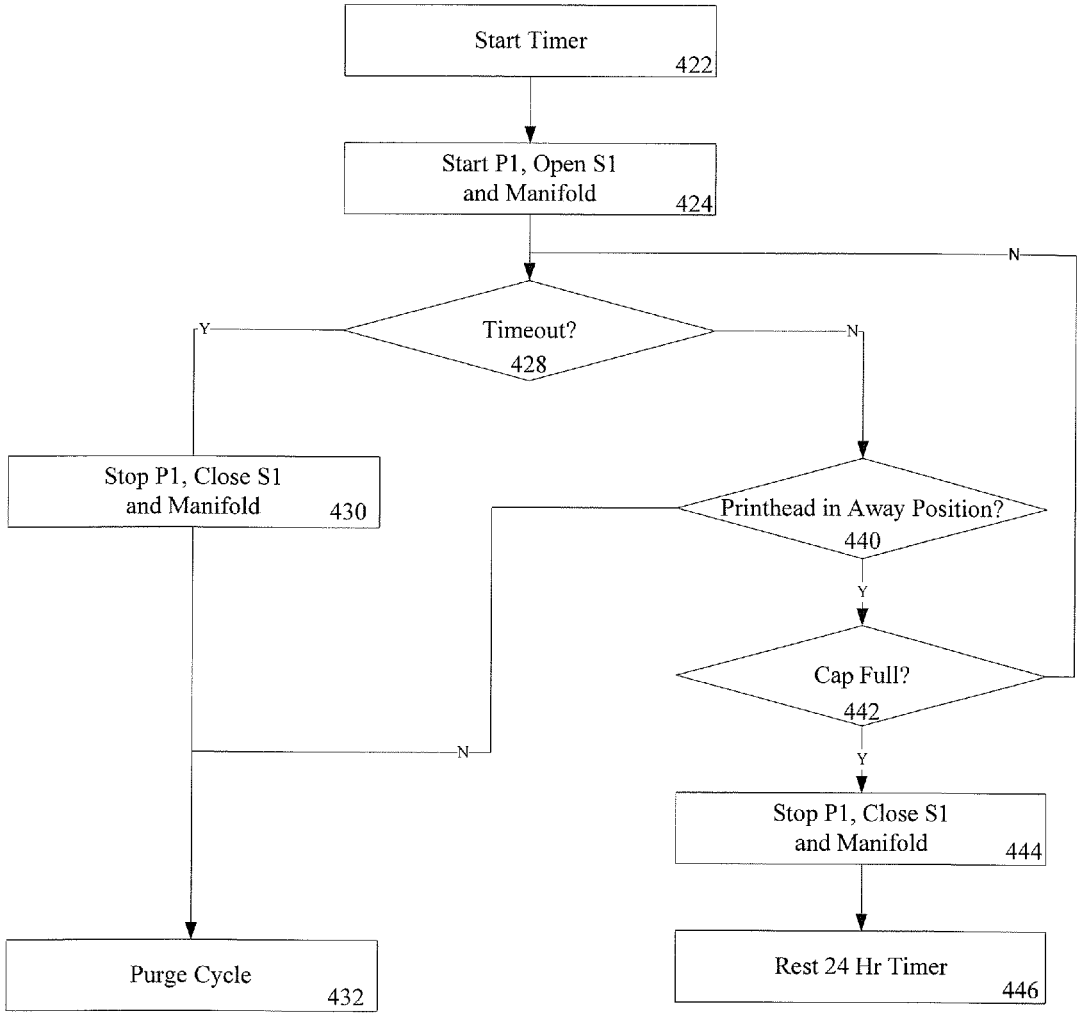

FIG. 4B is a flow diagram illustrating one embodiment a Fill cycle performed at hydration system 250. In one embodiment, the Fill cycle supplies fluid to print head capping and maintenance system 220 until sensor 257 detects that the fluid has reached the predetermined level or moisture threshold (e.g., has the water reached a fill limit, or has the humidity in cap reached an appropriate limit?). At processing block 422, a fill timer at controller 252 is activated.

At processing block 424, controller 252 activates Pump P1, solenoid S1 and the manifold 254 solenoids. At decision block 428, it is determined whether the timer has timed out. If the timer has timed out, controller 252 deactivates Pump P1, solenoid S1 and the manifold 254 solenoids, processing block 430. At processing block 432, hydration system 250 may enter the Purge cycle. Additionally, a warning message may be generated indicating the timeout.

If the timer has not timed out, it is determined whether the print head 165 has remained in the away position, processing block 440. If the print head 165 has not remained in the away position, control is returned to processing block 432 where hydration system 250 may enter the Purge cycle. Otherwise, a determination is made as to whether the fluid at cap 222 is at the predetermined threshold (e.g., sensor 257 is on), decision block 442.

If the hydration fluid is not detected as being at the predetermined threshold control is returned to decision block 428 for determination of a timeout. If cap 222 is at the predetermined threshold level, controller 252 deactivates Pump P1, solenoid S1 and the manifold 254 solenoids, processing block 444. At processing block 446, the twenty-four hour timer is reset.

Figure 4C:
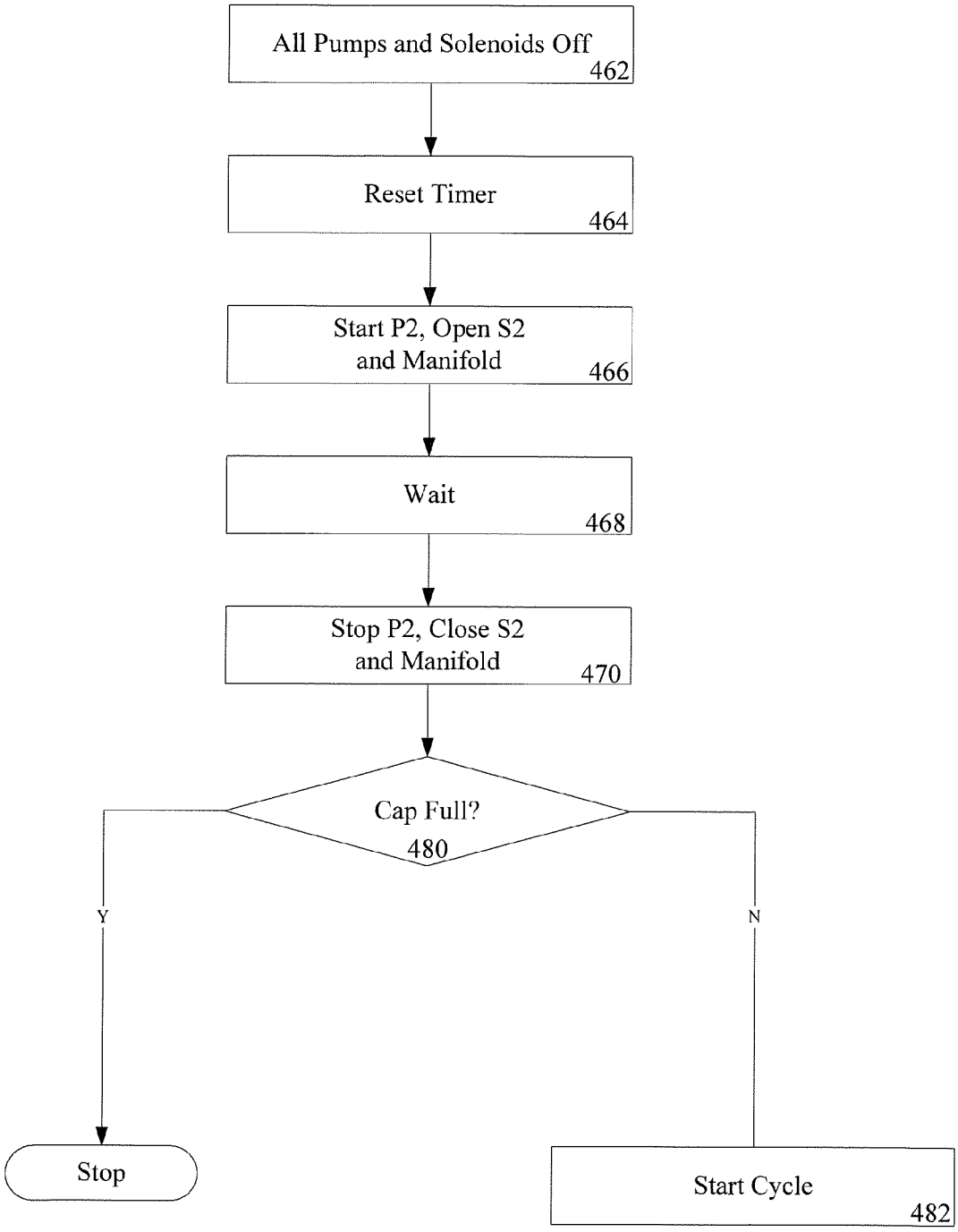

FIG. 4C is a flow diagram illustrating one embodiment a Purge cycle performed at hydration system 250. In one embodiment, the Purge cycle is implemented to flush the ink lines to prevent clogging from dehydrated ink or ink that contains settling particulate. At processing block 462, all pumps and solenoids within hydration system 250 are deactivated. At processing block 464, the fill timer is reset.

At processing block 466, controller 252 activates Pump P2, solenoid S2 and the manifold 254 solenoids. At processing block 468, a wait state is initiated. In one embodiment, the wait state is maintained for ten seconds. At processing block 468, controller 252 deactivates Pump P2, solenoid S2 and the manifold 254 solenoids. At decision block 480, a determination is made as to whether the fluid at cap 222 is at the predetermined threshold. If cap 222 is at the predetermined threshold, a warning message may be generated providing an indication to check the purge system. If not at the predetermined threshold, the Start cycle may be initiated.

Throughout the foregoing description, for the purposes of explanation, numerous specific details were set forth in order to provide a thorough understanding of the invention. It will be apparent, however, to one skilled in the art that the invention may be practiced without some of these specific details. Accordingly, the scope and spirit of the invention should be judged in terms of the claims which follow.

What is claimed is:

1. A printer comprising:

an ink jet print head having a plurality of nozzles to mark a printable recording medium with ink; and an ink system to provide ink to the nozzles; including:

a print head capping system to cap the nozzles whenever the nozzles are not in use; and a hydration system to supply a hydration fluid to the print head capping system to provide moisture to the ink at the nozzles while the nozzles are capped, including:

a fluid source;

a first fluid regulating device;

a fluid distribution system;

a second fluid regulating device;

a second fluid distribution system;

a first sensor to detect a fluid in a capping system; and a controller to activate the first fluid regulating device to supply the fluid from the fluid source to the fluid distribution system and ink at print head nozzles upon the controller determining that hydrating is to be performed and activates the second fluid regulating device and the second fluid distribution system to supply fluid from the fluid source to ink removal lines to prevent clogging of the ink removal lines.

2. The printer of claim 1, wherein the controller regulates ink hydration fluid from the hydration system to the capping system and to ink at the print head nozzles.

3. The printer of claim 2, wherein the hydration system further comprises a first timer monitored by the controller to determine an appropriate time for the hydrating cycle.

4. The printer of claim 2, wherein the capping system comprises:

a cap;

a maintenance station coupled to the cap; and a plurality of ink removal lines coupled to the maintenance station.

5. The printer of claim 4, wherein the controller initiates fluid delivery into the ink removal lines to prevent ink from clogging the ink lines.

6. The printer of claim 1, wherein the controller deactivates the first fluid regulating device and the fluid distribution system upon determining that hydrating should not continue.

7. The printer of claim 1, wherein the hydration system further comprises a second timer monitored by the controller to determine the fluid level remaining in the fluid source.

8. The printer of claim 1, wherein the fluid includes water.

9. A method comprising:

monitoring a fluid detection system within an inkjet printer;

determining when hydration fluid may be provided to a print head capping system; and supplying a hydration fluid from a hydration system to the capping system to provide moisture to ink at print head nozzles while the nozzles are capped by:

a controller activating a first fluid regulating device to supply the fluid from a fluid source to a fluid distribution system and to the ink at the nozzles upon the controller determining that hydrating is to be performed; and activating a second fluid regulating device to supply fluid from the fluid source to ink removal lines to prevent clogging of the ink removal lines.

10. The method of claim 9, wherein monitoring the fluid detection system comprises the controller monitoring a sensor that measures the fluid within the capping system.

11. The method of claim 10, wherein monitoring the fluid detection system comprises the controller monitoring a timer that is used to trigger the hydration system at a predetermined interval.

12. The method of claim 9, wherein supplying the hydration fluid into the one or more ink lines comprises the controller activating the second fluid regulating device and a fluid distribution system to supply a purge of fluid from a fluid source to ink removal lines.

13. A print head hydration system, comprising:

a fluid source;

a first fluid regulating device;

a fluid distribution system;

a second fluid regulating device;

a second fluid distribution system;

a first sensor to detect a fluid in a capping system; and a controller to activate the first fluid regulating device to supply the fluid from the fluid source to the fluid distribution system and ink at print head nozzles upon the controller determining that hydrating is to be performed and activates the second fluid regulating device and the second fluid distribution system to supply fluid from the fluid source to ink removal lines to prevent clogging of the ink removal lines.

14. The print head hydration system of claim 13, wherein the controller deactivates the first fluid regulating device and the fluid distribution system upon determining that hydrating is to be discontinued.

15. The print head hydration system of claim 13, further comprising a second sensor monitored by the controller to determine the fluid level remaining in the fluid source.

* * * * *